US010900301B2

(12) United States Patent
Tompkins

(10) Patent No.: US 10,900,301 B2
(45) Date of Patent: Jan. 26, 2021

(54) DRILLPIPE SPINNER

(71) Applicant: Paul H Tompkins, Austin, TX (US)

(72) Inventor: Paul H Tompkins, Austin, TX (US)

(73) Assignee: Paul H. Tompkins, Austin, TX (US)

( * ) Notice: Subject to any disclaimer, the term of this patent is extended or adjusted under 35 U.S.C. 154(b) by 0 days.

(21) Appl. No.: 16/413,214

(22) Filed: May 15, 2019

(65) Prior Publication Data

US 2020/0362648 A1 Nov. 19, 2020

(51) Int. Cl.
*E21B 19/16* (2006.01)

(52) U.S. Cl.
CPC ..... *E21B 19/163* (2013.01)

(58) Field of Classification Search
CPC ..... E21B 19/161; E21B 19/163
See application file for complete search history.

(56) References Cited

U.S. PATENT DOCUMENTS 4,765,401 A * 8/1988 Boyadjieff ..... E21B 19/20 166/77.53
4,774,861 A * 10/1988 Hamilton ..... E21B 19/168 81/57.19
5,660,087 A * 8/1997 Rae ..... E21B 19/168 81/57.16
7,000,502 B2 * 2/2006 Belik ..... E21B 19/161 81/57.2
7,076,852 B2 * 7/2006 Penman ..... B23P 19/061 29/426.5
7,707,914 B2 * 5/2010 Pietras ..... E21B 19/163 81/57.16
8,074,537 B2 * 12/2011 Hunter ..... E21B 19/168 81/57.2
10,370,913 B2 * 8/2019 Soyland ..... E21B 19/161
2003/0132030 A1 * 7/2003 Tompkins ..... E21B 19/164 175/52

* cited by examiner

*Primary Examiner* — Matthew R Buck

(57) ABSTRACT

An improved drillpipe spinner having a drillpipe spinner frame mounted to a hanging tree, a spinner arm frame assembly, two drive roller shaft assemblies, two pressure roller assemblies, two idler shaft assemblies, a single hydraulic motor, a gear cover, two spinner gripper cylinders and steel heat treated knurled rollers. A cluster of gears mounted in place, with the hydraulic motor to drive the cluster of gears, turn the steel knurled rollers. The two hydraulic cylinders are extended to engage the pressure rollers. The engaged spinner turns the drillpipe for makeup or spinout operation.

16 Claims, 4 Drawing Sheets

DRILLPIPE SPINNER

CROSS-REFERENCE TO RELATED APPLICATIONS

None.

TECHNICAL FIELD

The present invention relates to oil field drill rig equipment and in particular to an improved drillpipe spinner.

BACKGROUND

A drillpipe spinner is a device that is used for making up or spinning out drillpipe on a drilling rig. The drillpipe spinner is hung from the drill floor by a steel cable and is operated by a hydraulic valve to be closed around the drillpipe. When the drillpipe spinner is needed for drillpipe operations the drillpipe spinner is moved into position. The drillpipe spinner arms are closed around the drillpipe by a hydraulic valve. Another hydraulic valve is used to activate a single hydraulic motor to spin the drillpipe.

SUMMARY

By using the pressure settings on the hydraulic valve an optimum pressure setting can be reached to achieve the best results of the effectiveness of the spinup or spinout operation of the drillpipe. The angle of the two drillpipe spinner cylinders are engineered into the drillpipe spinner body at an angle to allow the best effective gripping around the drillpipe. This allows proper pressure settings to allow proper gripping action around the drillpipe.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the following discussion and in the claims, the terms "including" and "comprising" are used in an open-ended fashion, and thus should be interpreted to mean "including, but not limited to." Also, the term "connect" or "connected" or "attach" or "attached," where used if at all is intended to mean either an indirect or direct connection or attachment. Thus, if a first component connects or attaches to a second component, that connection or attachment may be through a direct connection or attachment or through an indirect connection or attachment via other components and connections or attachments.

Certain terms are used throughout the following description and claims to refer to particular system components and method steps. As one skilled in the art will appreciate, different companies may refer to a component by different names. This document does not intend to distinguish between components that differ in name but not function.

Figure 1A:
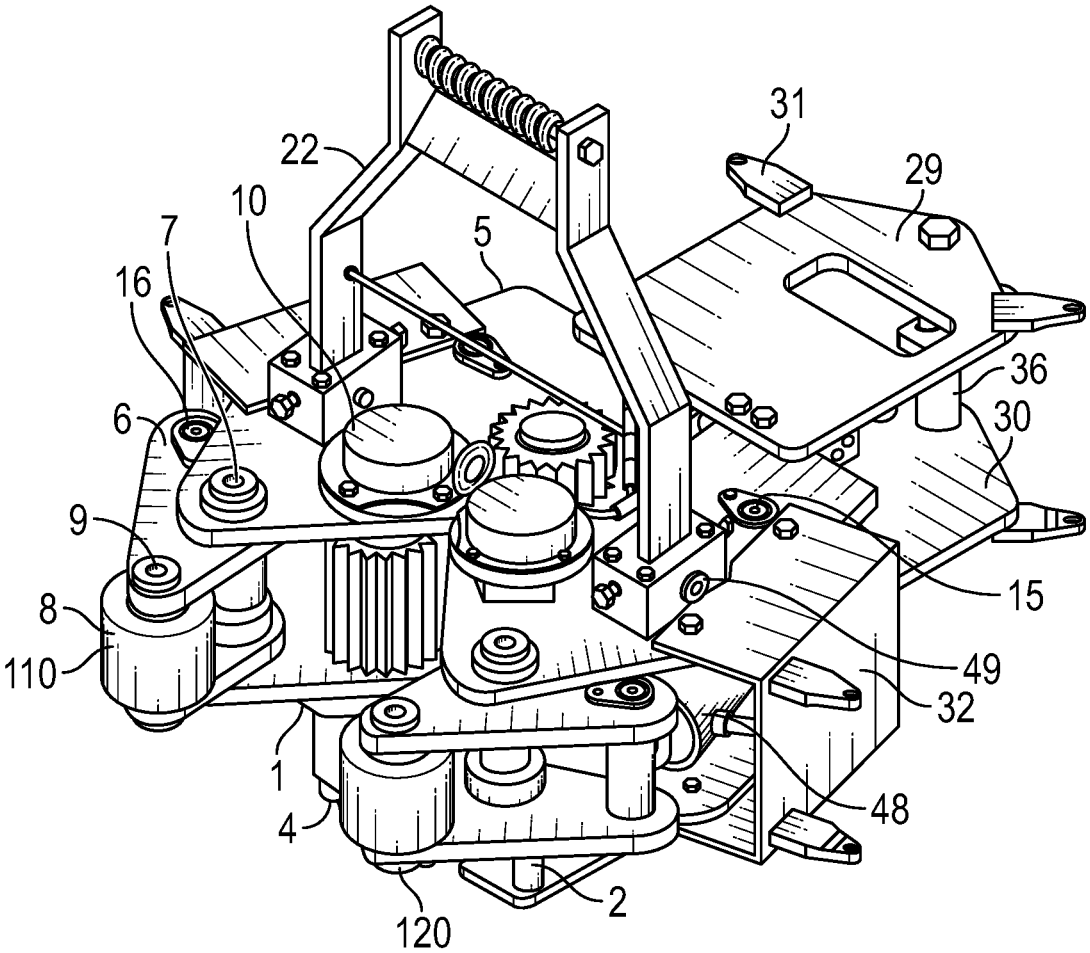
FIG. 1A is an isometric top view of the drillpipe spinner of the present invention.

FIGS. 1A/1B, 2A/2B and 3 will be described together. FIG. 1A is an isometric top view of the drillpipe spinner of the present invention. A component list is provided in table 1:

TABLE 1

PARTS LIST

| ITEM | DESCRIPTION |
|---|---|
| 1 | Spinner Frame |
| 2 | Gear Cover Pan |
| 3 | Idler Shaft Assembly |
| 4 | Drive Roller Shaft Assembly |
| 5 | Hydraulic Motor Assembly |
| 6 | Spinner Arm Assembly |
| 7 | Arm Pivot Pins |
| 8 | Pressure Roller Assembly |
| 9 | Pressure Roller Pin |
| 10 | Drive Roller Top Bearing Cap |
| 15 | Cylinder Pin A |
| 16 | Cylinder Pin B |
| 22 | Spinner Hanger Tree |
| 29 | Hanger Plate #1 |
| 30 | Hanger Plate #2 |
| 31 | Spinner Guard #1 |
| 32 | Hanger Side Plate |
| 36 | Spinner Guard #2 |
| 39 | Hawe Valve Manifold |
| 46 | Pressure Divider |
| 47 | Spinner Cylinder #1 |
| 48 | Spinner Cylinder #2 |
| 49 | Spinner Hanger Tree Pins |

Figure 3:
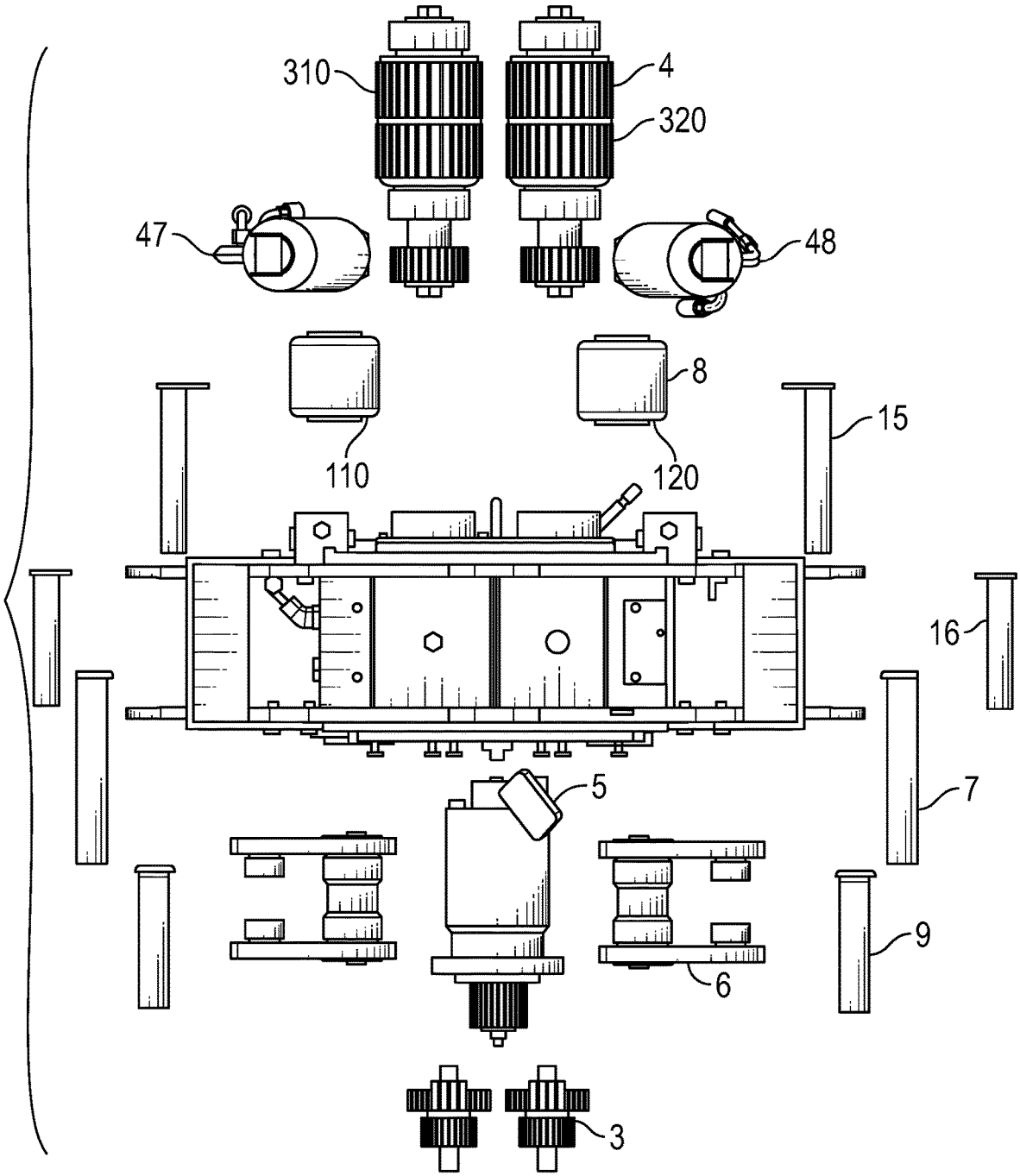
FIG. 3 is an exploded view illustration of the drillpipe spinner of FIGS. 1A and 1B.

Note that pressure roller assembly 8 provides a pair of rollers 110, 120 and drive roller shaft assembly 4 provides a pair of knurled rollers 310, 320 (FIG. 3).

Figure 1B:
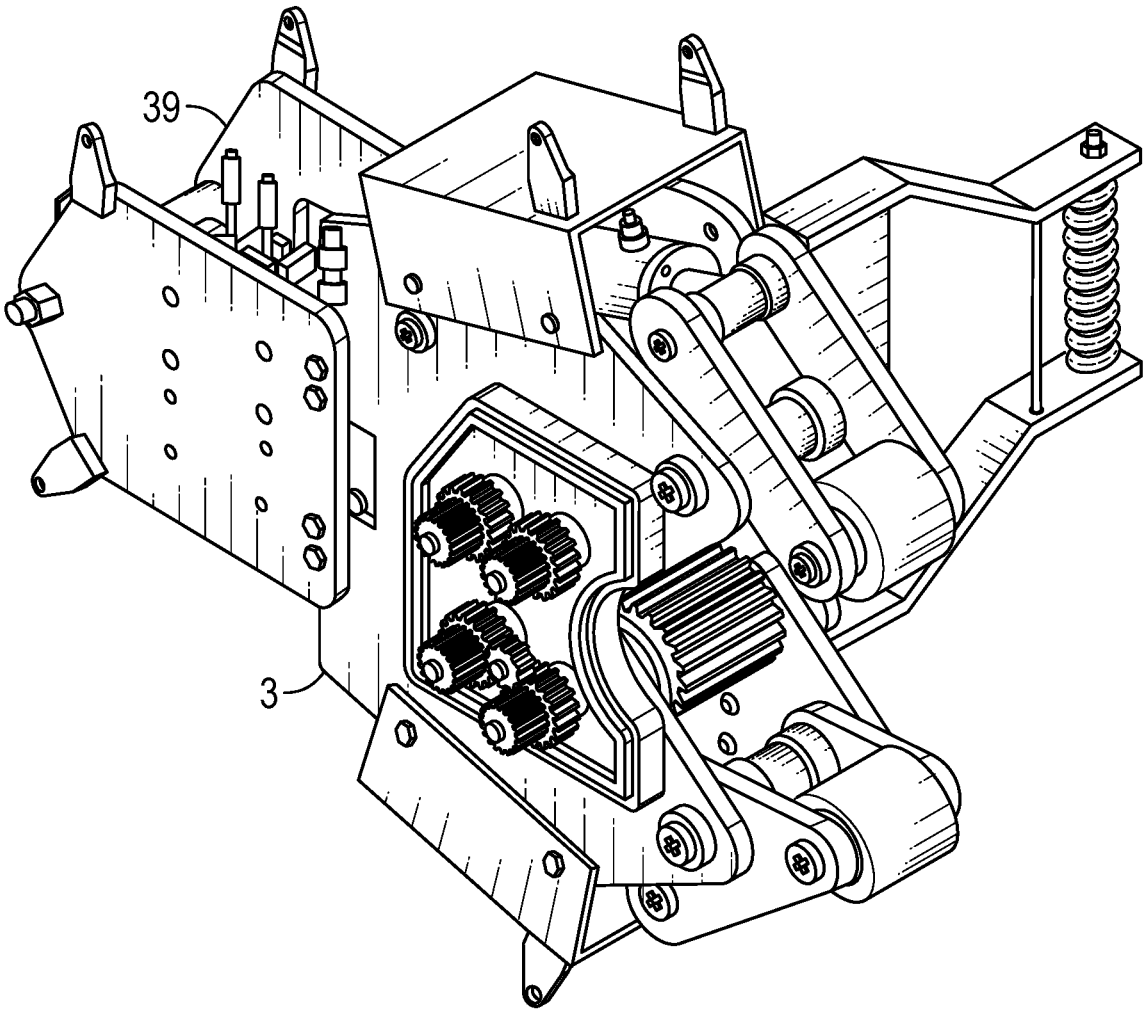
FIG. 1B is an isometric bottom view of the drillpipe spinner of FIG. 1A.

FIG. 1B is an isometric bottom view of the drillpipe spinner of FIG. 1A. The bottom view of 1B shows the idler pan assembly 3 and the Hawe valve manifold 39.

Figure 2B:
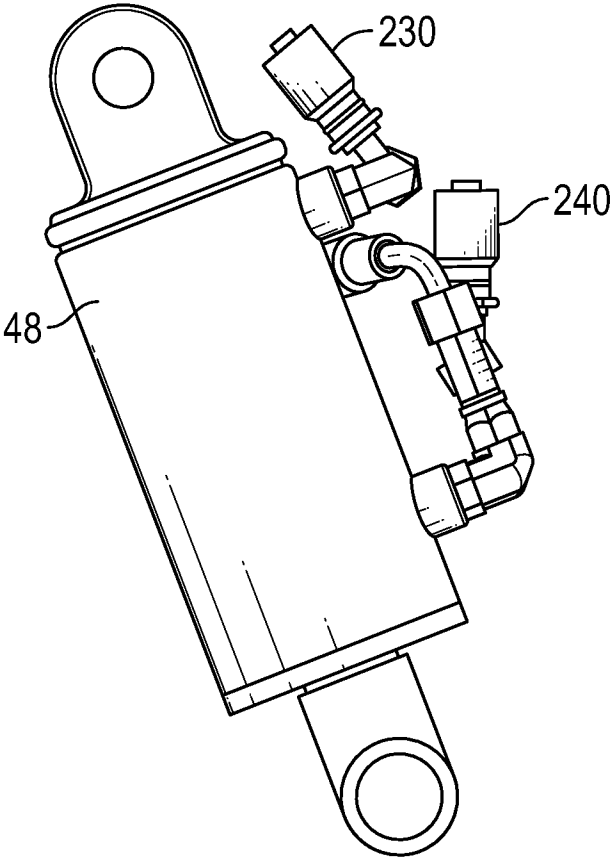
FIGS. 2A and 2B are isometric side view illustrations of hydraulic cylinders of the present invention.
Figure 2A:
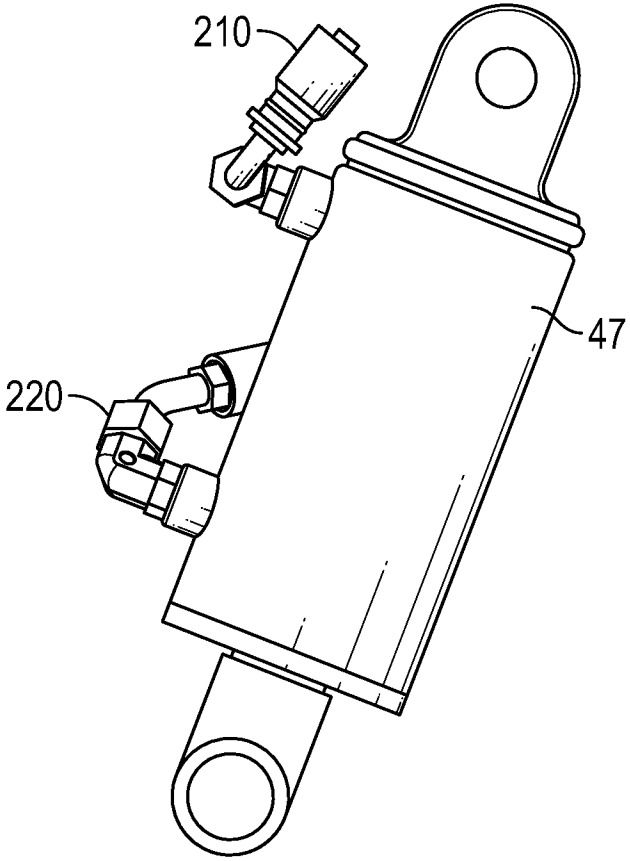

FIGS. 2A and 2B are isometric side view illustrations of hydraulic cylinders 47, 48 of the present invention. Hydraulic cylinders 47, 48 connect to a hydraulic pressure source with plumbing conduits and attachments 210, 220, 230, 240. Cylinders 47, 48 are mounted to the spinner apparatus frame 1 behind pressure roller assembly 8 with an angle of 111 degrees plus or minus 3 degrees in relation to an imaginary x-y axis. The mounting angle provides directional force to rollers of pressure roller assembly 8 to cause gripper rollers 8 to grip a drillpipe for improved contact with knurled rollers 310, 320 of drive roller shaft assembly 8.

FIG. 3 is a diagrammatic illustration of an exploded view of a spinner of the present invention. It depicts the major internal component view of the drillpipe spinner reflecting the drillpipe spinner frame, the spinner arm frame assembly, the two drive roller shaft assemblies, the two pressure roller assemblies, the two idler shaft assemblies, the single hydraulic motor, the gear cover, the two spinner gripper cylinders and the steel knurled rollers. Identified components include Idler shaft assembly 3, Drive roller shaft assembly 4, hydraulic motor assembly 5, spinner arm assembly 6, Arm pivot pins 7, pressure roller assembly 8, pressure roller pins 9, cylinder pin A 15, cylinder pin B, 16, spinner cylinder #1 47 and spinner cylinder #2 48.

Reference number 1 designates the drillpipe spinner frame that contains the single hydraulic motor assembly 5 complete with a hydraulic motor gear that drives the idler shaft assembly 3. The idler shaft assembly 3 drives the Steel Knurled Roller assembly.

Pressure roller assembly 8 provides pressure rollers 110, 120 connected to spinner arm assembly 6. The pressure rollers 110, 120 are attached to the spinner arm assembly 6 by one or more pressure roller pins 9. The pressure rollers 110, 120 are attached to spinner arm frame assembly 2. Hydraulic cylinders 13 actuate rollers 110, 120 to grip a drillpipe and bring the drillpipe into contact with knurled rollers 310, 320, which in turn are caused to turn by motor 5. Drillpipe is gripped to knurled rollers 310, 320 by pressure rollers 110, 120 with sufficient force to break and spin the drillpipe without deforming the drillpipe.

Drillpipe spinners are used for making up and breakout out a string of drillpipe used in drilling operations, having a single hydraulic motor 5 to a drive motor gear that drives two idler step gears 3 to then drive two gears attached to two drive shafts 6. The two drive shafts each have two heat treated knurled rollers 310, 320 that are set in place by a key stock.

The drillpipe spinner of the present invention also has two hydraulic cylinders 47, 48 attached to two arms of the spinner arm assembly 6 that when hydraulically activated will close pressure rollers 110, 120 around the drillpipe with improved, even optimum, gripping force. This improved clamping force leads to the efficient gripping force from the heat treated knurled rollers, that then leads to the efficient quick spin up and break out of the drillpipe. The single hydraulic motor is engaged causing the two special heat treated knurled rollers to turn engaging the drillpipe to spinup or by engaging the single hydraulic motor in reverse to spin out. With an operational range of 3000 pounds per square inch (psi) to 3200 psi for the spinner's inlet pressure, the single motor spinner is able to achieve improved, up to optimal, clamping force and rotation of the drillpipe. One or more torque arrestors 29 prevent the spinner assembly from spinning around the drillpipe.

The use of a drillpipe spinner of the present disclosure provides many advantages over the prior art including a simplified assembly structure and the ability to fine tune the pressure and angle at which the drillpipe is gripped by the spinner for improved performance. With a critical angle in the range between 18 degrees to 24 degrees (108 degrees to 115 degrees) that can be measured variently from either of the two center point locations where hydraulic arm cylinders 47, 48 are pinned to the spinner's frame housing 1. From a vertical symmetrical axis between the two hydraulic arms cylinders, the critical angle range is 36 degrees to 48 degrees. Heat treatment of the pressure and knurled rollers bestows the rollers with improve performance over non-heated rollers.

Drillpipe spinner assembly 1 is mounted to hanging tree assembly 22. The hanging tree assembly is a torque resistor and further includes a first hanger plate 29, a second hanger plate 30, spinner guard 31, hanger slide plate 32, and spinner hanger tree pins 49.

Idler shaft assembly 3 is mounted in the hanging tree assembly so as to almost be housed within it. A Hawe valve manifold 39 is revealed mounted between first hanger plate 29 and second hanger plate 30.

Many modifications and other embodiments of the drillpipe spinner described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A drillpipe spinner comprising:

a spinner frame;

pressure rollers supported by the spinner frame on a spinner arm assembly having pivot pins;

a cluster of gears mounted on the spinner frame;

knurled rollers operatively coupled to the cluster of gears and configured to engage a drillpipe, the knurled rollers driven by a single hydraulic motor utilized to drive the cluster of gears;

hydraulic cylinders mounted behind the pressure rollers and operatively engaged with the pressure rollers to pivot the pressure rollers about the pivot pins, the hydraulic cylinders angled between approximately 108 degrees and 115 degrees relative to an axis when viewed from above or below the drillpipe spinner and extendable to vary the pressure rollers between a disengaged position and an engaged position to hold the drillpipe against the knurled rollers; and a hydraulic valve fluidly coupled to the hydraulic cylinders and configured to control a pressure applied by the pressure rollers to the drillpipe in the engaged position, wherein the pressure applied by the pressure rollers is different from an inlet pressure of the drillpipe spinner, and wherein the knurled rollers are configured to turn the drillpipe for makeup or spinout operation.

2. The drillpipe spinner of claim 1, wherein each of the pivot pins is associated with a corresponding pressure roller of the pressure rollers, and wherein the pivot pins define the only pivot for the corresponding pressure rollers.

3. A drillpipe spinner assembly for pipe makeup or spin operations, the drillpipe spinner assembly comprising:

a spinner frame;

a gear cover pan mounted to the spinner frame;

an idler shaft assembly mounted to the frame;

a drive roller shaft assembly including one or more knurled rollers and drive roller shaft top bearings, the drive roller assembly operationally engageable with the idler shaft assembly;

a hydraulic motor assembly operationally connected to the idler shaft assembly the hydraulic motor assembly including a single hydraulic motor;

a spinner arm assembly operationally engageable with the drive roller assembly;

two or more arm pivot pins that rotationally attach the spinner arm assembly to the spinner frame;

a pressure roller assembly comprising two or more pressure rollers;

two or more pressure roller pins that rotationally attach the pressure rollers to the pressure roller assembly;

two or more spinner cylinders engageable with the two or more pressure rollers and extendable to cause the two or more pressure rollers to hold a drillpipe against the one or more knurled rollers at a pressure that is optimized via a hydraulic valve relative to an inlet pressure to the drillpipe spinner assembly to control the hold of the drillpipe by the two or more pressure rollers;

two or more cylinder pins that attach the spinner cylinders to the frame;

a spinner hanger tree mounted to the frame;

two or more hanger plates, each having a side plate, the two or more hanger plates being attached to the spinner hanger tree and to the frame;

a plurality of spinner guards attached to the two or more hanger plates; and a manifold housed in at least one of the two or more hanger plates.

4. The drillpipe spinner assembly of claim 3, further comprising two or more drive roller top bearing caps attached to the frame.

5. The drillpipe spinner assembly of claim 3, wherein the two or more spinner cylinders engage the two or more pressure rollers at an angle.

6. The drillpipe spinner assembly of claim 5, wherein the angle is between the range of 108 degrees to 115 degrees in relation to an imaginary x-y axis.

7. The drillpipe spinner assembly of claim 5, wherein the angle is determined to be between the range of 18 degrees to 24 degrees in relation to an imaginary x-y axis.

8. The drillpipe spinner assembly of claim 3, wherein the two or more pressure rollers have been treated with heat.

9. The drillpipe spinner assembly of claim 8, wherein the one or more knurled rollers have been treated with heat.

10. The drillpipe spinner assembly of claim 3, wherein the drillpipe spinner assembly has an operational range of between 3000 to 3200 pounds per square inch.

11. The drillpipe spinner assembly of claim 3, wherein each of the pivot pins is associated with a corresponding pressure roller of the pressure rollers, and wherein the pivot pins define the only pivot for the corresponding pressure rollers.

12. A drillpipe spinner assembly for pipe makeup or spin operations, the drillpipe spinner assembly comprising:

a spinner frame;

an idler shaft assembly mounted to the spinner frame;

a drive roller shaft assembly including one or more heat-treated knurled rollers and drive roller shaft top bearings, the drive roller shaft assembly operationally engageable with the idler shaft assembly;

a hydraulic motor assembly operationally connected to the idler shaft assembly, the hydraulic motor assembly including a single hydraulic motor;

a spinner arm assembly operationally engageable with the drive roller assembly;

two or more arm pivot pins that rotationally attach the spinner arm assembly to the spinner frame;

a pressure roller assembly comprising two or more heat treated pressure rollers;

two or more pressure roller pins that rotationally attach the pressure rollers to the pressure roller assembly;

two or more spinner cylinders engaged with the two or more pressure rollers at an angle between 108 degrees and 115 degrees in relation to an imaginary x-y axis to provide a directional force to the two or more pressure rollers to cause the two or more pressure rollers to hold a drillpipe against the one or more knurled rollers at a pressure that is optimized via a hydraulic valve relative to the operational pressure range of the drillpipe spinner assembly;

two or more cylinder pins that attach the spinner cylinders to the frame;

a spinner hanger tree mounted to the frame;

two or more hanger plates, each having a side plate, the two or more hanger plates being attached to the spinner hanger tree and to the frame;

a plurality of spinner guards attached to the two or more hanger plates; and a manifold housed in at least one of the two or more hanger plates.

13. The drillpipe spinner assembly of claim 12, further comprising two or more drive roller top bearing caps attached to the frame.

14. The drillpipe spinner assembly of claim 12, wherein the angle is alternatively determined to be between the range of 18 degrees to 24 degrees in relation to an imaginary x-y axis.

15. The drillpipe spinner assembly of claim 12, wherein the drillpipe spinner assembly has an operational range of between 3000 to 3200 pounds per square inch.

16. The drillpipe spinner assembly of claim 12, wherein each of the pivot pins is associated with a corresponding pressure roller of the pressure rollers, and wherein the pivot pins define the only pivot for the corresponding pressure rollers.

* * * * *